US011702942B2

(12) United States Patent
Goroshchak et al.

(10) Patent No.: US 11,702,942 B2
(45) Date of Patent: Jul. 18, 2023

(54) ROTARY MACHINE, GAS TURBINE INCLUDING SAME, AND ROTARY MACHINE ASSEMBLY METHOD

(71) Applicant: DOOSAN ENERBILITY CO., LTD, Changwon-si (KR)

(72) Inventors: Iurii Goroshchak, Gimhae (KR); Jin Bong Ha, Gimhae (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/568,025

(22) Filed: Jan. 4, 2022

(65) Prior Publication Data

US 2022/0243599 A1 Aug. 4, 2022

(30) Foreign Application Priority Data

Feb. 2, 2021 (KR) ..... 10-2021-0015040

(51) Int. Cl.
*F01D 5/32* (2006.01)

(52) U.S. Cl.
CPC ..... *F01D 5/326* (2013.01); *F05D 2220/32* (2013.01); *F05D 2230/60* (2013.01); *F05D 2240/30* (2013.01)

(58) Field of Classification Search
CPC .. F01D 5/326; F05D 2220/32; F05D 2230/60; F05D 2240/30
See application file for complete search history.

(56) References Cited

U.S. PATENT DOCUMENTS 4,265,595 A * 5/1981 Bucy, Jr. ..... F01D 5/3007 416/221
4,478,554 A * 10/1984 Surdi ..... F01D 5/323 416/221
5,236,309 A * 8/1993 Van Heusden ..... F01D 5/323 416/221

(Continued)

FOREIGN PATENT DOCUMENTS

EP 0110744 A1 6/1984
EP 1382800 A2 1/2004

(Continued)

OTHER PUBLICATIONS

EESR, dated Jun. 14, 2022.
KR OA, dated Jul. 13, 2022.
The JP Office Action, dated Nov. 18, 2022.

*Primary Examiner* — David E Sosnowski
*Assistant Examiner* — Theodore C Ribadeneyra
(74) *Attorney, Agent, or Firm* — Harvest IP Law, LLP

(57) ABSTRACT

A rotary machine is provided. The rotary machine includes a rotor disk including a plurality of slots, a plurality of blades mounted on an outer circumferential surface of the rotor disk, each of the blades having a root part inserted into an associated one of the slots, and a retainer restraining axial movement of the plurality of blades, wherein the retainer includes an inner fixing member inserted into a bottom of the slot, an outer fixing member inserted into a lower surface of the root part to abut against the inner fixing member, and a spacer inserted between the outer fixing member and the bottom of the slot to prevent the outer fixing member from being separated.

20 Claims, 13 Drawing Sheets

(56) References Cited

U.S. PATENT DOCUMENTS

| | | | | |
|---|---|---|---|---|
| 6,905,311 | B2 * | 6/2005 | Leathart | F01D 5/323 416/500 |
| 8,192,167 | B2 * | 6/2012 | Helmis | F01D 5/3015 416/204 R |
| 8,439,635 | B2 * | 5/2013 | Uskert | F01D 9/042 415/189 |
| 8,956,122 | B2 * | 2/2015 | Helmis | F01D 5/323 416/221 |
| 2006/0018756 | A1 | 1/2006 | Schroder | |
| 2009/0324414 | A1 * | 12/2009 | Helmis | F01D 5/3015 416/220 R |
| 2012/0177499 | A1 | 7/2012 | Helmis | |
| 2013/0216387 | A1 * | 8/2013 | Torkaman | F01D 5/323 29/889.21 |
| 2015/0330235 | A1 * | 11/2015 | Polyzopoulos | F01D 5/323 416/221 |
| 2016/0265369 | A1 * | 9/2016 | Benson | F01D 5/3007 |
| 2018/0179903 | A1 * | 6/2018 | Pieri | F01D 5/3007 |
| 2018/0266259 | A1 * | 9/2018 | Rehnsch | F01D 5/3015 |
| 2018/0298766 | A1 * | 10/2018 | Jung | F01D 5/326 |
| 2019/0120069 | A1 * | 4/2019 | Burdgick | F01D 5/3007 |
| 2020/0056485 | A1 * | 2/2020 | Shemyatovskiy | F02C 3/06 |
| 2020/0157954 | A1 * | 5/2020 | Burdgick | F01D 5/323 |
| 2020/0157955 | A1 * | 5/2020 | Burdgick | F01D 5/326 |

FOREIGN PATENT DOCUMENTS

| | | | |
|---|---|---|---|
| GB | 2038959 | A | 7/1980 |
| JP | 59-101599 | A | 6/1984 |
| JP | 2006037954 | A | 2/2006 |
| JP | 2015086749 | A | 5/2015 |
| JP | 2018-505994 | A | 3/2018 |
| JP | 2020115010 | A | 7/2020 |
| KR | 20180105890 | A | 10/2018 |
| KR | 20190089432 | A | 7/2019 |
| KR | 102042505 | B1 | 11/2019 |
| KR | 20200013475 | A | 2/2020 |

* cited by examiner

ROTARY MACHINE, GAS TURBINE INCLUDING SAME, AND ROTARY MACHINE ASSEMBLY METHOD

CROSS REFERENCE TO RELATED APPLICATION

This application claims priority to Korean Patent Application No 10-2021-0015040, filed on Feb. 2, 2021, the disclosure of which is incorporated herein by reference in its entirety.

BACKGROUND

1. Field

Apparatuses and methods consistent with exemplary embodiments relate to a rotary machine, a gas turbine including the same, and a method of assembling rotary machine.

2. Description of the Related Art

A gas turbine is a combustion engine in which a mixture of air compressed by a compressor and fuel is combusted to produce a high temperature gas that drives a turbine. The gas turbine is used to drive electric generators, aircrafts, ships, trains, or the like.

The gas turbine includes a compressor, a combustor, and a turbine. The compressor serves to intake external air, compress the air, and transfer the compressed air to the combustor. The compressed air compressed by the compressor has a high temperature and a high pressure. The combustor serves to mix compressed air supplied from the compressor and fuel and combust a mixture of compressed air and fuel to produce combustion gas which is discharged to the turbine. Turbine blades in the turbine are rotated by the combustion gas to generate power. The generated power is used in various fields such as generation of electricity and driving of mechanical device.

A rotary machine, such as a compressor, a combustor, or the like, which performs a rotational motion, includes a rotor disk and blades coupled to the rotor disk. The blades need to be stably fixed to the rotor disk, but there is a problem with the blades moving in an axial direction during rotation.

SUMMARY

Aspects of one or more exemplary embodiments provide a rotary machine capable of fixing blades, a gas turbine including the same, and a method of assembling rotary machine.

Additional aspects will be set forth in part in the description which follows and, in part, will become apparent from the description, or may be learned by practice of the exemplary embodiments.

According to an aspect of an exemplary embodiment, there is provided a rotary machine including: a rotor disk including a plurality of slots; a plurality of blades mounted on an outer circumferential surface of the rotor disk, each of the blades having a root part inserted into an associated one of the slots; and a retainer restraining axial movement of the plurality of blades, wherein the retainer includes an inner fixing member inserted into a bottom of the slot, an outer fixing member inserted into a lower surface of the root part to abut against the inner fixing member, and a spacer inserted between the outer fixing member and the bottom of the slot to prevent the outer fixing member from being separated.

The outer fixing member may include a body portion inserted into the root part and a support plate protruding from the body portion in a lateral direction and bent to abut against an end of the spacer.

The bottom of the slot may be provided with an inner groove into which the inner fixing member is inserted, and a mounting groove connected to an upper portion of the inner groove and extending from the inner groove to a side surface of the rotor disk.

The lower surface of the root part may be provided with a first groove into which the inner fixing member is inserted, a second groove into which the outer fixing member is inserted and formed deeper than the first groove, and a third groove extending from the second groove to the side surface of the root part.

The inner fixing member may have a column shape and may be inserted into the inner groove and the first groove.

The spacer may include a support block supporting the outer fixing member and protrusions protruding from the support block toward the blade to be inserted into the third groove.

Two protrusions may be spaced apart from each other, and a middle groove may be formed between the two protrusions, and a protruding support step portion may be formed on the support block.

The support plate may include a first portion protruding from the body portion in the lateral direction to abut against the bottom of the third groove and a second portion bent from the first portion to abut against the spacer.

The spacer may include an accommodation groove, and the support plate may further include a third portion bent from the second portion and inserted into the accommodation groove.

The spacer may include a coupling protrusion, and the support plate may include a coupling hole into which the coupling protrusion is fitted.

According to an aspect of another exemplary embodiment, there is provided a gas turbine including: a compressor configured to compress air introduced from an outside; a combustor configured to mix the compressed air compressed by the compressor with fuel and combust an air-fuel mixture to produce combustion gas; and a rotary machine rotated by the combustion gas produced by the combustor, wherein the rotary machine includes: a rotor disk including a plurality of slots; a plurality of blades mounted on an outer circumferential surface of the rotor disk, each of the blades having a root part inserted into an associated one of the slots; and a retainer restraining axial movement of the plurality of blades, wherein the retainer includes an inner fixing member inserted into a bottom of the slot, an outer fixing member inserted into a lower surface of the root part to abut against the inner fixing member, and a spacer inserted between the outer fixing member and the bottom of the slot to prevent the outer fixing member from being separated.

The outer fixing member may include: a body portion inserted into the root part and a support plate protruding from the body portion in a lateral direction and bent to abut against an end of the spacer.

The bottom of the slot may be provided with an inner groove into which the inner fixing member is inserted, and a mounting groove connected to an upper portion of the inner groove and extending from the inner groove to a side surface of the rotor disk.

The lower surface of the root part may be provided with a first groove into which the inner fixing member is inserted, a second groove into which the outer fixing member is inserted and formed deeper than the first groove, and a third groove extending from the second groove to the side surface of the root part.

The spacer may include a support block supporting the outer fixing member and protrusions protruding from the support block toward the blade to be inserted into the third groove.

Two protrusions may be spaced apart from each other, and a middle groove may be formed between the two protrusions, and a protruding support step portion may be formed on the support block.

The support plate may include a first portion protruding from the body portion in the lateral direction to abut against the bottom of the third groove and a second portion bent from the first portion to abut against the spacer.

The spacer may include an accommodation groove, and the support plate may further include a third portion bent from the second portion and inserted into the accommodation groove.

The spacer may include a coupling protrusion, and the support plate may include a coupling hole into which the coupling protrusion is fitted.

According to an aspect of another exemplary embodiment, there is provided a method of assembling a rotary machine including a rotor disk and a plurality of blades, the method including: mounting an inner fixing member by inserting a column-shaped inner fixing member into an inner groove formed in a bottom of a slot of the rotor disk; coupling a blade to the slot of the rotor disk; mounting an outer fixing member by inserting the outer fixing member which supports the blade into a second groove formed in a lower surface of a root part of the blade; mounting a spacer by inserting a spacer which supports the outer fixing member into an inner side of the outer fixing member; and bending a support plate formed on the outer fixing member to abut against an end of the spacer.

According to the rotary machine according to the exemplary embodiments, because the retainer includes the inner fixing member, the outer fixing member, and the spacer, the rotary machine can support the blade stably.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
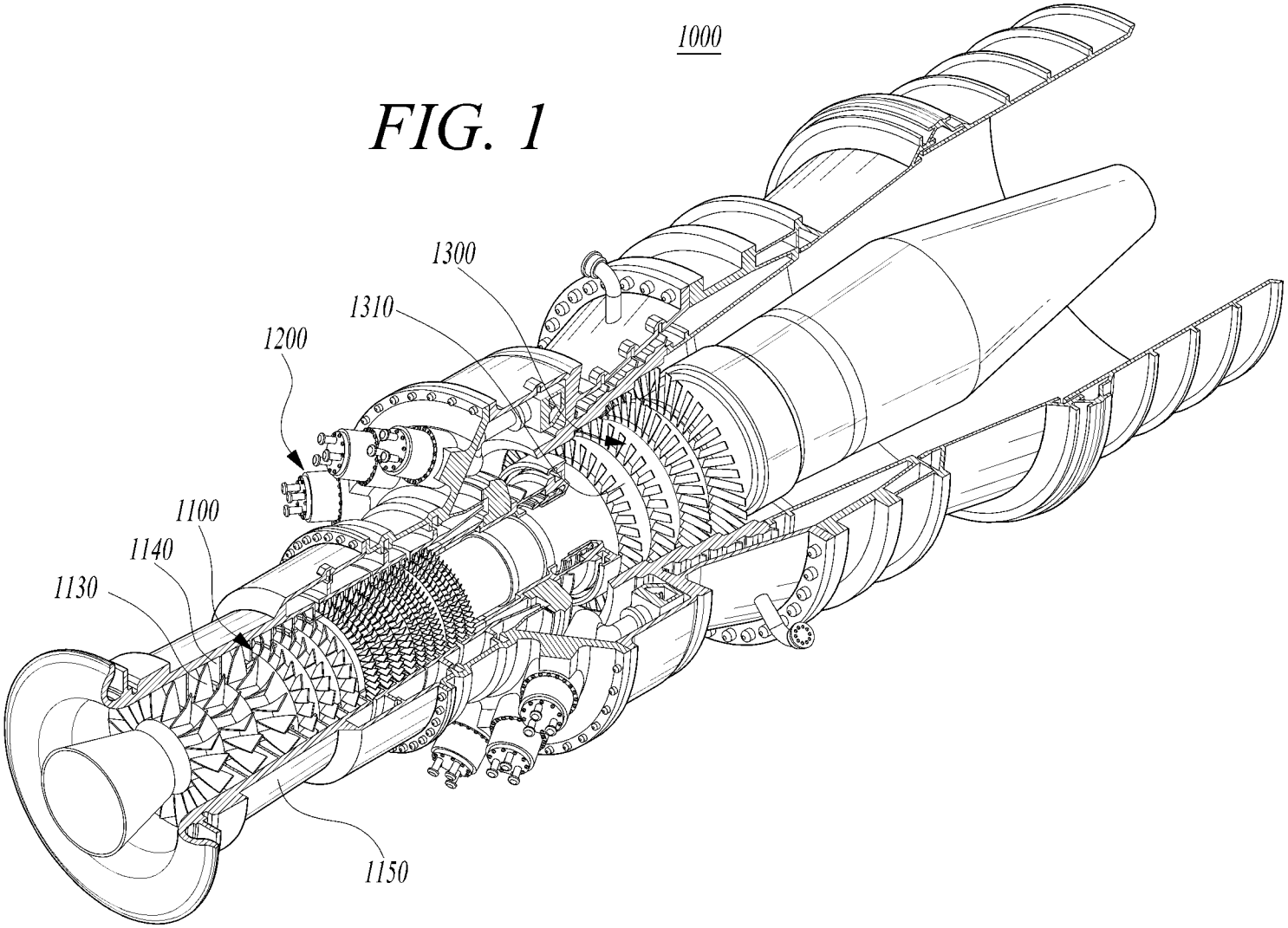
FIG. 1 is a view illustrating an interior of a gas turbine according to a first exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

Terms used herein are used to describe specific embodiments only and are not intended to limit the scope of the disclosure. As used herein, an element expressed as a singular form includes a plurality of elements, unless the context clearly indicates otherwise. Further, it will be understood that the term "comprising" or "including" specifies the presence of stated features, numbers, steps, operations, elements, parts, or combinations thereof, but does not preclude the presence or addition of one or more other features, numbers, steps, operations, elements, parts, or combinations thereof.

Hereinafter, exemplary embodiments will be described in detail with reference to the accompanying drawings. It is noted that like reference numerals refer to like elements throughout the different drawings and exemplary embodiments. In certain embodiments, a detailed description of known functions and configurations that may obscure the gist of the disclosure will be omitted. For the same reason, some of the elements in the drawings are exaggerated, omitted, or schematically illustrated.

Figure 2:
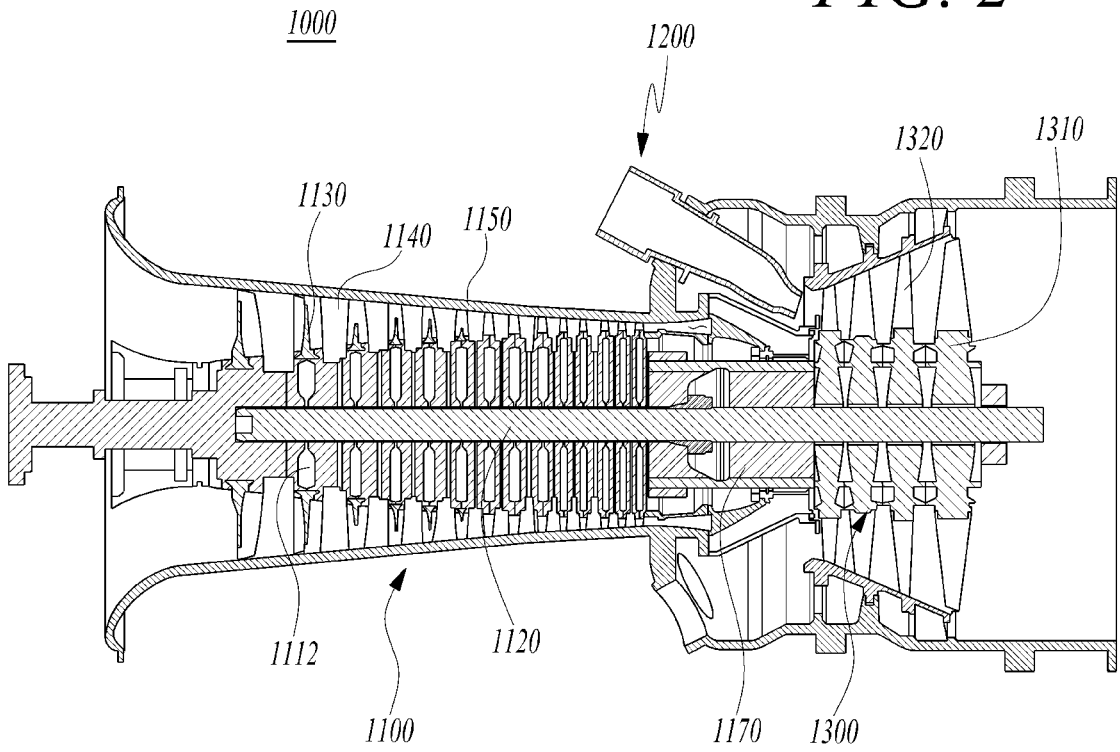
FIG. 2 is a longitudinal-sectional view illustrating a part of the gas turbine of FIG. 1.

FIG. 1 is a view illustrating an interior of a gas turbine according to an exemplary embodiment, and FIG. 2 is a longitudinal-sectional view of the gas turbine of FIG. 1.

An ideal thermodynamic cycle of a gas turbine may comply with the Brayton cycle. The Brayton cycle consists of four thermodynamic processes: an isentropic compression (i.e., an adiabatic compression), an isobaric combustion, an isentropic expansion (i.e., an adiabatic expansion) and isobaric heat ejection. That is, in the Brayton cycle, thermal energy may be released by combustion of fuel in an isobaric environment after atmospheric air is sucked and compressed into high pressure air, hot combustion gas may be expanded to be converted into kinetic energy, and exhaust gas with residual energy may be discharged to the outside. As such, the Brayton cycle consists of four thermodynamic processes including compression, heating, expansion, and heat ejection.

The gas turbine 1000 employing the Brayton cycle includes a compressor 1100, a combustor 1200, and a turbine 1300. Although the following description will be described with reference to FIG. 1, the present disclosure may be widely applied to other turbine engines having similar configurations to the gas turbine 1000 illustrated in FIG. 1.

Referring to FIGS. 1 and 2, the compressor 1100 of the gas turbine 1000 may suck and compress air. The compressor 1100 may supply the compressed air to the combustor 1200 and also supply the cooling air to a high temperature region of the gas turbine 1000 that is required to be cooled. Because the sucked air is compressed in the compressor 1100 through an adiabatic compression process, the pressure and temperature of the air passing through the compressor 1100 increases.

The compressor 1100 may be designed in a form of a centrifugal compressor or an axial compressor, wherein the centrifugal compressor is applied to a small-scale gas turbine, whereas a multi-stage axial compressor 1100 is applied to a large-scale gas turbine 1000 illustrated in FIG. 1 to compress a large amount of air. In the multi-stage axial compressor 1100, the compressor blades 1130 rotate along with the rotation of a central tie rod 1120 and rotor disks to compress the introduced air while moving the compressed air to rear-stage compressor vanes 1140. As the air passes through the compressor blades 1130 formed in multiple stages, the air is compressed increasingly to a higher pressure.

A plurality of compressor vanes 1140 are mounted in a housing 1150 in multiple stages. The compressor vanes 1140 guide the compressed air moved from front-stage compressor blades 1130 to rear-stage compressor blades 1130. At least some of the compressor vanes 1140 may be mounted so as to be rotatable within a predetermined range for adjustment of an air inflow or the like.

The compressor 1100 may be driven using a portion of the power output from the turbine 1300. To this end, the rotary shaft of the compressor 1100 and the rotary shaft of the turbine 1300 may be directly connected by a torque tube 1170. In the large-scale gas turbine 1000, almost half of the output produced by the turbine 1300 may be consumed to drive the compressor 1100.

The combustor 1200 may mix compressed air supplied from the compressor 1100 with fuel and combust the air-fuel mixture at a constant pressure to produce a high-energy combustion gas. That is, the combustor 1200 mixes the inflowing compressed air with fuel and combusts the mixture to produce a high-temperature and high-pressure combustion gas with high energy. The combustor 1200 increases the temperature of the combustion gas to a temperature at which components of the combustor and components of the turbine can withstand without being thermally damaged through the isobaric combustion process.

The combustor 1200 may include a plurality of burners arranged in a housing in a form of a cell and having a fuel injection nozzle, a combustor liner defining a combustion chamber, and a transition piece that is a connection between the combustor and the turbine.

The high-temperature and high-pressure combustion gas discharged from the combustor 1200 is supplied to the turbine 1300. The high-temperature and high-pressure combustion gas supplied to the turbine 1300 applies impulse or impact force to the turbine blades 1320 of the turbine 1300 while expanding, thereby generating a rotational torque. The obtained rotational torque is transferred to the compressor 1100 through the torque tube 1170, and power exceeding the power required to drive the compressor 1100 is used to drive a generator or the like.

The turbine 1300 includes a plurality of rotor disks 1310, a plurality of turbine blades 1320 radially disposed on each of the rotor disks 1310, and a retainer 1400 for fixing each of the turbine blades 1320. The turbine blade 1320 may be coupled to the rotor disk 1310 in a dovetail manner or the like. In addition, the rotor disk 1310 is provided with turbine vanes fixed to a housing to guide a flow direction of combustion gas passing through the turbine blades 1320.

Figure 3:
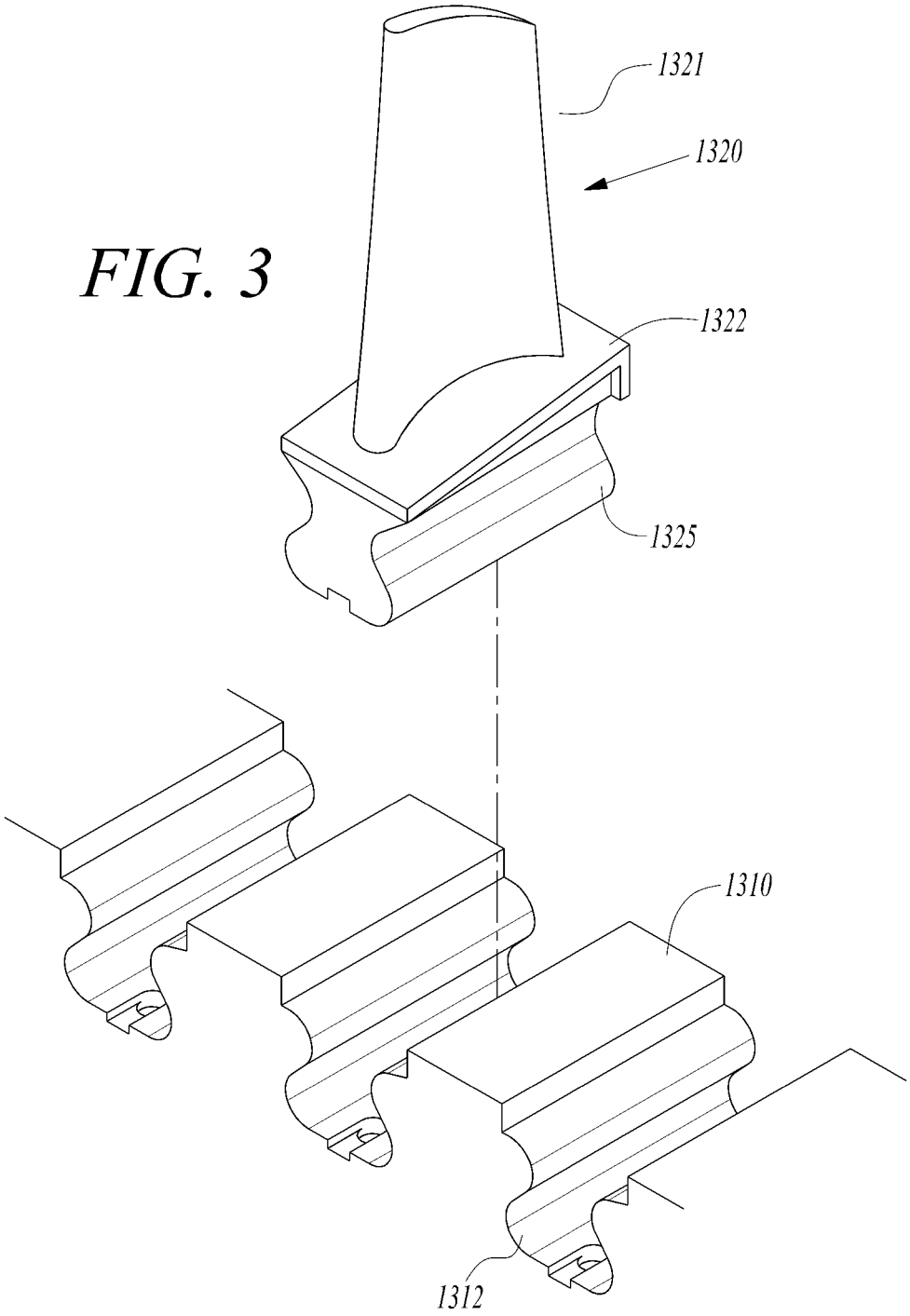
FIG. 3 is a perspective view illustrating a blade and a rotor disk according to the first exemplary embodiment.
Figure 4:
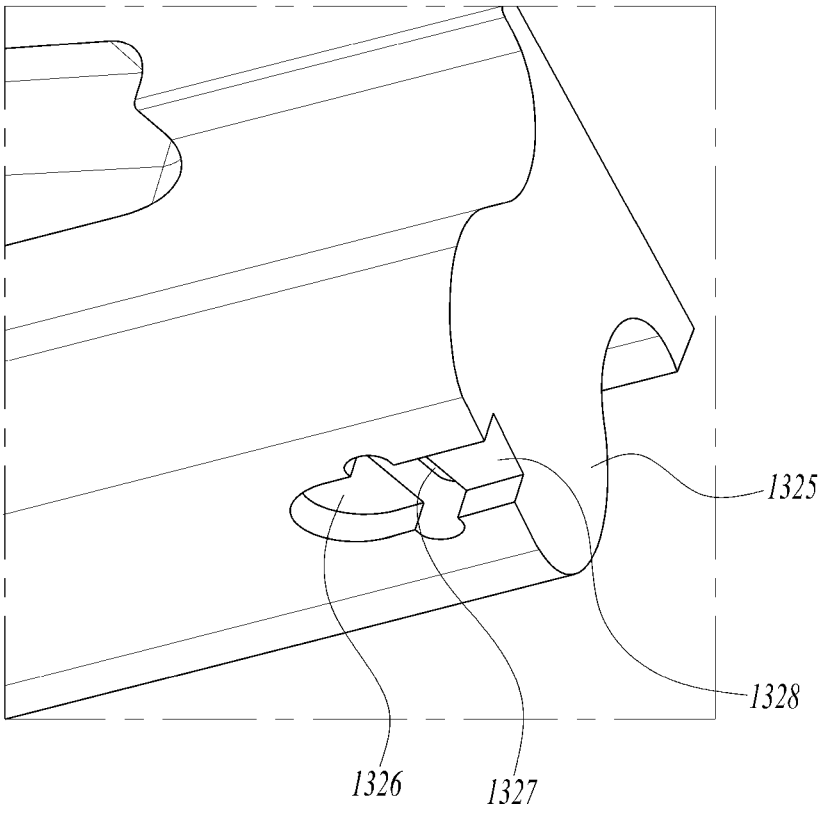
FIG. 4 is a partial perspective view illustrating a root part according to the first exemplary embodiment.
Figure 5:
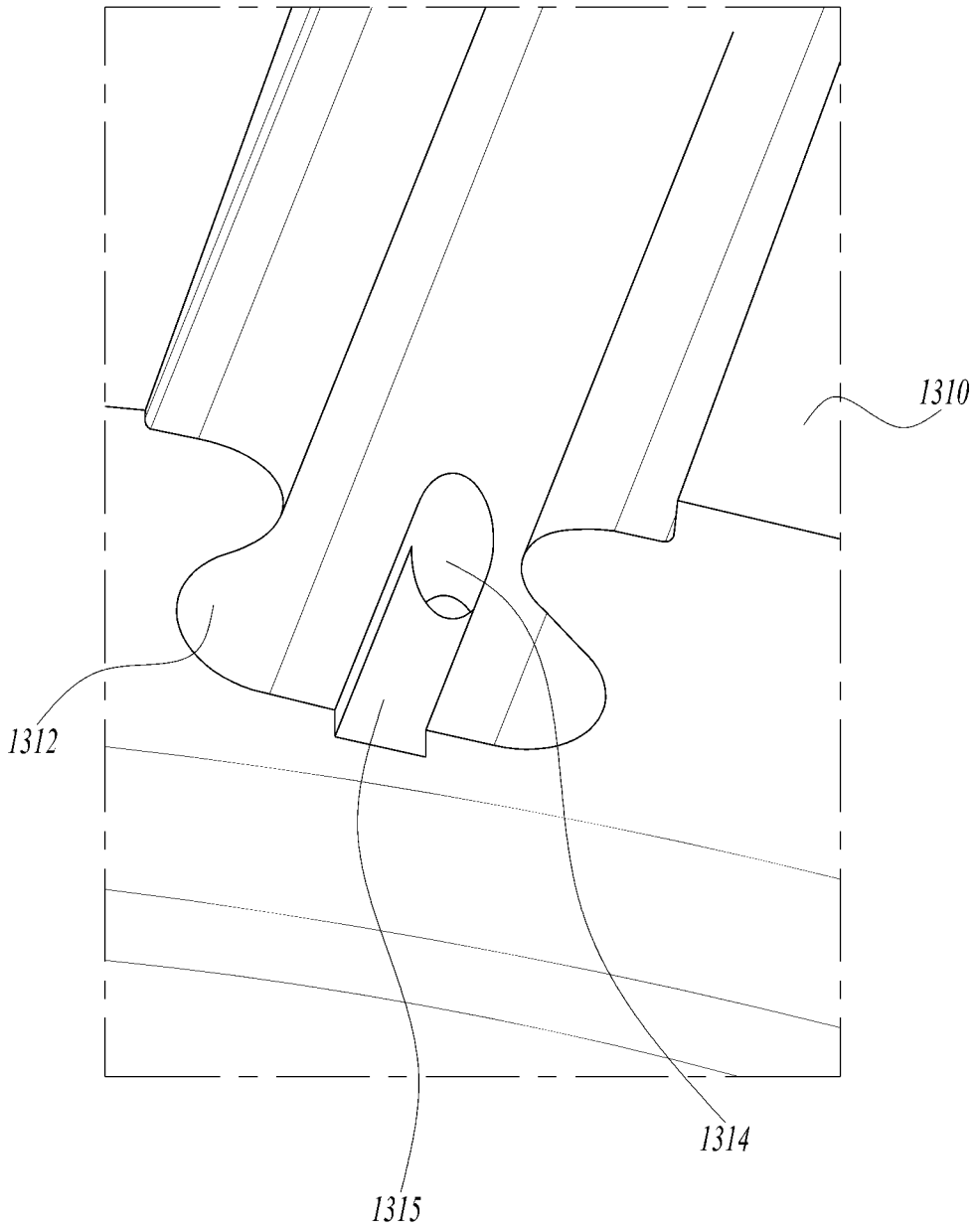
FIG. 5 is a partial perspective view illustrating a rotor disk according to the first exemplary embodiment.
Figure 6:
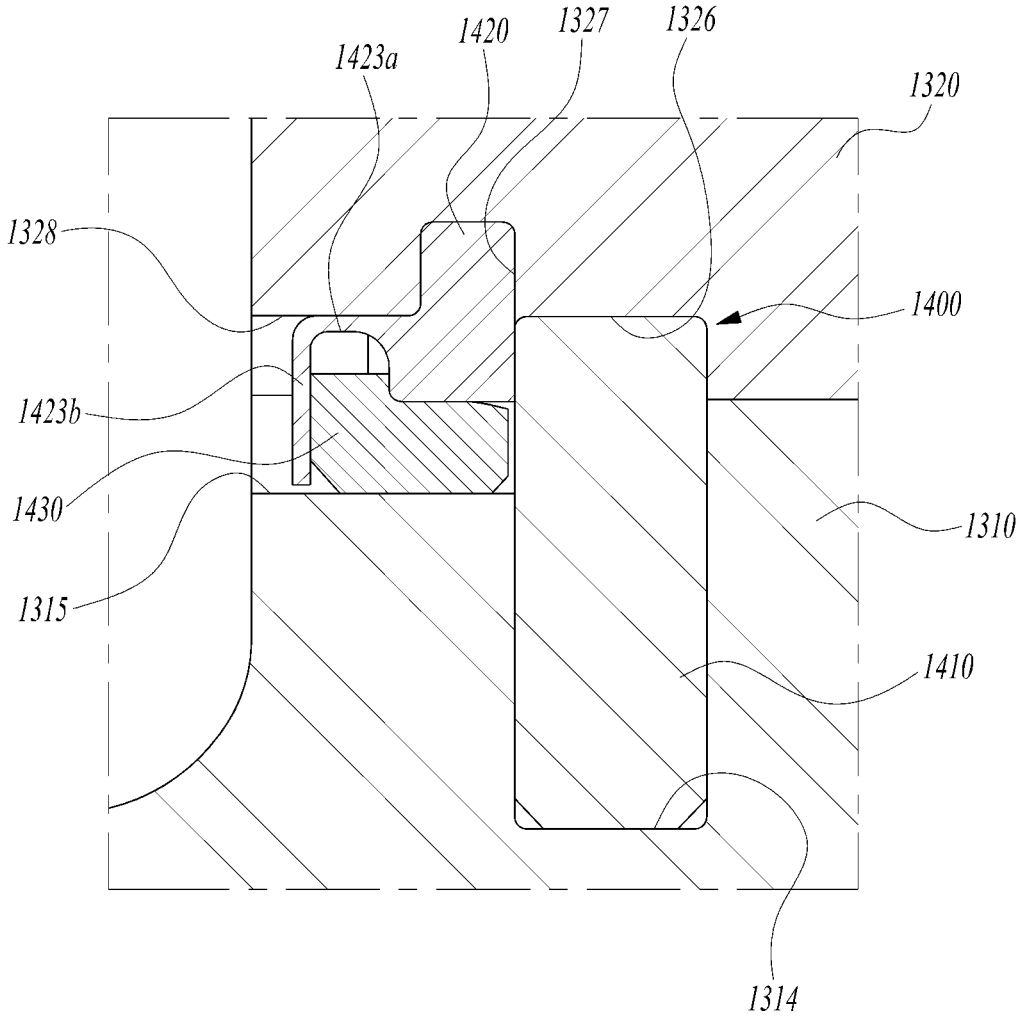
FIG. 6 is a sectional view illustrating a retainer coupled to the rotor disk and the blade according to the first exemplary embodiment.

FIG. 3 is a perspective view illustrating a blade and a rotor disk according to the first exemplary embodiment, FIG. 4 is a partial perspective view illustrating a root part according to the first exemplary embodiment, FIG. 5 is a partial perspective view illustrating a rotor disk according to the first exemplary embodiment, and FIG. 6 is a sectional view illustrating a retainer coupled to the rotor disk and the blade according to the first exemplary embodiment.

The rotary machine is a rotary device including a rotor disk and blades, and includes the compressor 1100 and the turbine 1300. Although the turbine 1300 is described as an example of the rotary machine, the disclosure is not limited thereto, and the rotary machine may include the compressor 1100.

Referring to FIGS. 3 to 6, each rotor disk 1310 has a substantially disk shape, and includes a plurality of slots 1312 formed in an outer circumferential portion thereof. Each of the slots 1312 a fir-tree-shaped curved surface, and each of the turbine blades 1320 is inserted into the associated slot 1312.

The turbine blade 1320 includes a plate-shaped airfoil part 1321, a platform part 1322 coupled to a lower portion of the airfoil part 1321, and a root part 1325 protruding downward from the platform part 1322. The airfoil part 1321 may be formed of an airfoil-shaped curved plate and may have an airfoil shape optimized according to the specifications of a gas turbine 1000. The airfoil part 1321 may have a leading edge disposed on an upstream side and a trailing edge disposed on a downstream side based on a flow direction of combustion gas.

A plurality of film cooling holes are formed on a surface of the airfoil part 1321 so that the film cooling holes communicate with a cooling path formed in the airfoil part 1321 to supply cooling air to the surface of the airfoil part 1321.

The platform part 1322 may have a substantially rectangular plate or rectangular pillar shape disposed between the airfoil part 1321 and the root part 1325. The side of the platform part 1322 contacts the side of a platform part 1322 of an adjacent turbine blade 1320, thereby maintaining a gap between the turbine blades 1320. A cooling path may be formed in the airfoil part 1321, the platform part 1322, and the root part 1325 so that cooling air supplied from the rotor disk 1310 flows in the cooling path.

The root part 1325 has a substantially fir-tree-shaped curved portion corresponding to the curved portion formed in the slot 1312 of the rotor disk 1310. The root part 1325 may be inserted into the slot 1312 in an axial direction (i.e., a direction parallel to the central axis of the rotor disk).

The retainer 1400 includes an inner fixing member 1410 inserted into a bottom of the slot 1312, an outer fixing member 1420 inserted into a lower side of the root part 1325 to abut against the inner fixing member 1410, and a spacer 1430 inserted between the outer fixing member 1420 and the bottom of the slot 1312 to prevent the outer fixing member 1420 from being separated.

Figure 7:
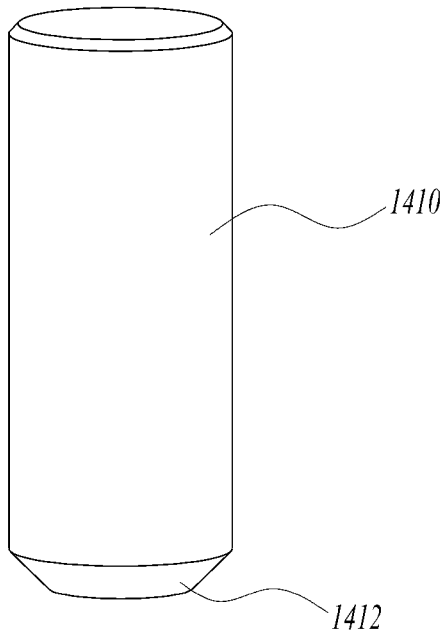
FIG. 7 is a perspective view illustrating an inner fixing member according to the first exemplary embodiment.
Figure 8:
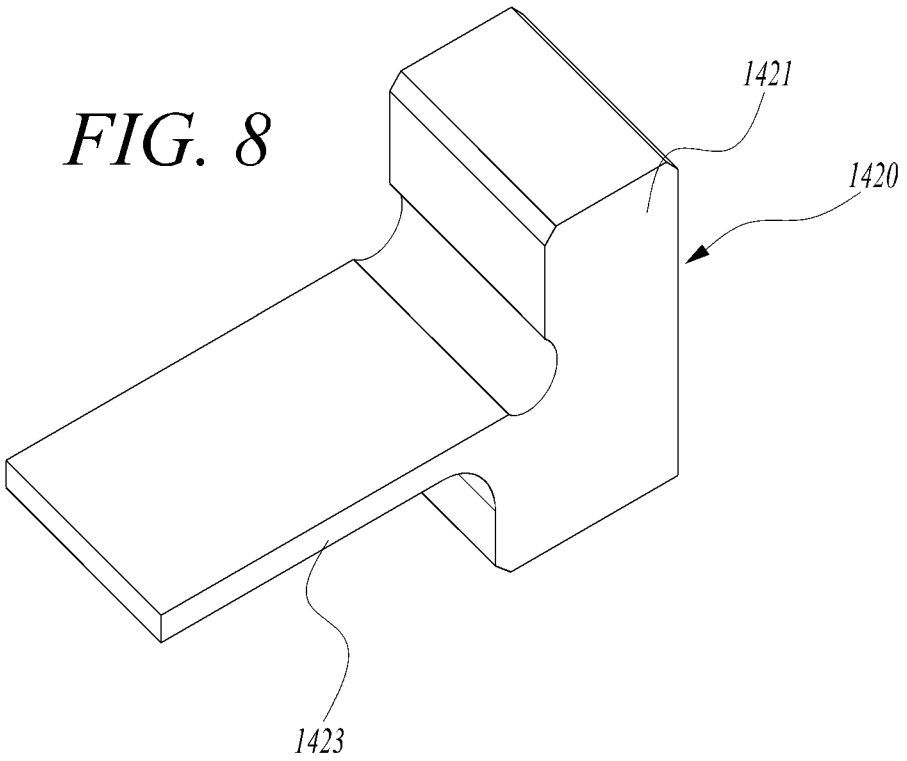
FIG. 8 is a perspective view illustrating an outer fixing member according to the first exemplary embodiment.
Figure 9:
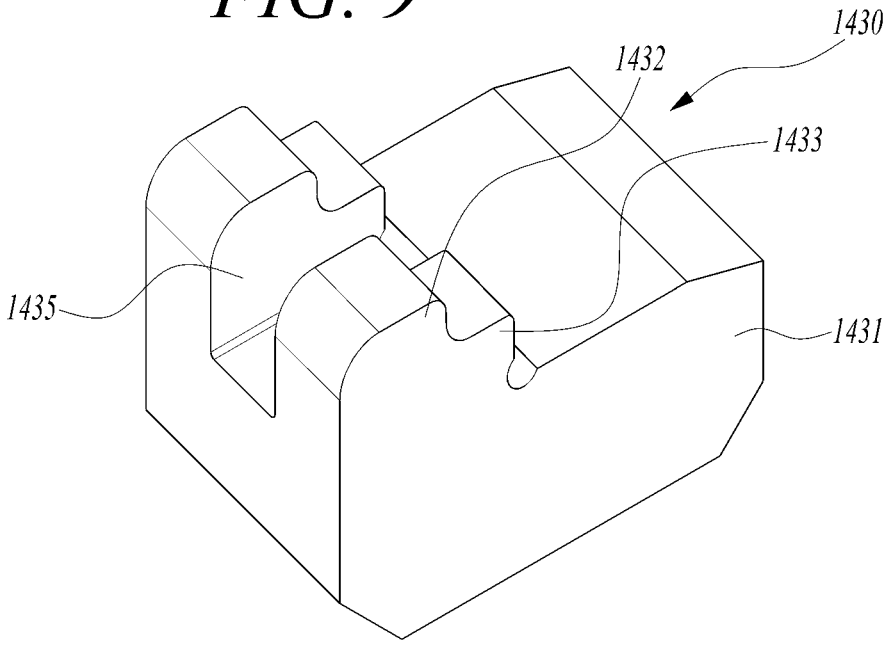
FIG. 9 is a perspective view illustrating a spacer according to the first exemplary embodiment.

FIG. 7 is a perspective view illustrating an inner fixing member according to the first exemplary embodiment, FIG. 8 is a perspective view illustrating an outer fixing member according to the first exemplary embodiment, and FIG. 9 is a perspective view illustrating a spacer according to the first exemplary embodiment.

Referring to FIGS. 5 to 9, the bottom of the slot 1312 is provided with an inner groove 1314 into which the inner fixing member 1410 is inserted and a mounting groove 1315 connected to an upper side of the inner groove 1314 and extending form the inner groove 1314 to a side surface of the rotor disk 1310. The inner groove 1314 has a circular cross section and is formed deeper than the mounting groove 1315.

On the other hand, a lower surface of the root part 1325 is provided with a first groove 1326 into which the inner fixing member 1410 is inserted, a second groove 1327 into which the outer fixing member 1420 is inserted and formed deeper than the first groove 1326, and a third groove 1328 extending from the second groove 1327 to the side surface of the root part 1325.

The first groove 1326 has a circular cross-section such that the inner fixing member 1410 can be inserted, and the second groove 1327 is formed to have a greater width than the first groove 1326 and the third groove 1328 so that the second groove 1327 protrudes beyond side surfaces of the first groove 1326 and the third groove 1328. The third groove 1328 defines a passage through which parts can be inserted.

The inner fixing member 1410 may be formed in a shape of a column, such as a cylindrical or rectangular column. The inner fixing member 1410 may be inserted into the inner groove 1314 and the first groove 1326, and have a tapered portion 1412 at a longitudinal end that contacts the bottom of the inner groove 1314 in the inner fixing member 1410.

The outer fixing member 1420 is inserted into the second groove 1327 so that the outer fixing member 1420 is supported in contact with the inner fixing member 1410 and the second groove 1327. The outer fixing member 1420 includes a body portion 1421 inserted into the second groove 1327 and a support plate 1423 protruding in the axial direction from the body portion 1421. The support plate 1423 protrudes from a side surface of the body portion 1421 and is bent to contact an end of the spacer 1430 to support the spacer 1430.

The spacer 1430 may include a support block 1431 supporting the outer fixing member 1420 and protrusions 1432 protruding from the support block 1431 toward the turbine blade 1320. The support block 1431 may be inserted into the mounting groove 1315, and the protrusions 1432 may be inserted into the third groove 1328.

The support block 1431 contacts an inner end of the outer fixing member 1420 to prevent the outer fixing member 1420 from being separated from the second groove 1327. The two protrusions 1432 are spaced apart from each other, and a middle groove 1435 extending downward is formed between the protrusions 1432. In addition, the support block 1431 has a protruding support step portion 1433 to allow a tool to be inserted into the middle groove 1435 and hung on the support step portion 1433 while the spacer 1430 is being separated so that the spacer 1430 can be easily separated.

The support plate 1423 is bent in a state in which the spacer 1430 is mounted and comes into contact with an outer end of the spacer 1430, thereby preventing the spacer 1430 from being separated between the turbine blade 1320 and the rotor disk 1310 by the support plate 1423.

The support plate 1423 may have a first portion 1423*a* protruding from the body portion 1421 in a lateral direction to contact the bottom of the third groove 1328, and a second portion 1423*b* bent from the first portion 1423*a* to contact the spacer 1430. The first portion 1423*a* may contact the protrusion 1432, and the second portion 1423*b* may contact the protrusion 1432 and the support block 1431.

According to the exemplary embodiment, the inner fixing member 1410 and the outer fixing member 1420 are inserted into the groove and contact each other to prevent the turbine blade 1320 from moving in the axial direction of the rotor disk 1310. In addition, the spacer 1430 may be mounted on the inner side of the inner fixing member 1410 so that the inner fixing member 1410 can be stably fixed to the turbine blade 1320. Further, the spacer 1430 may be stably fixed without being separated by the support plate 1423.

Hereinafter, a method of assembling the rotary machine according to an exemplary embodiment will be described.

Figure 10A:
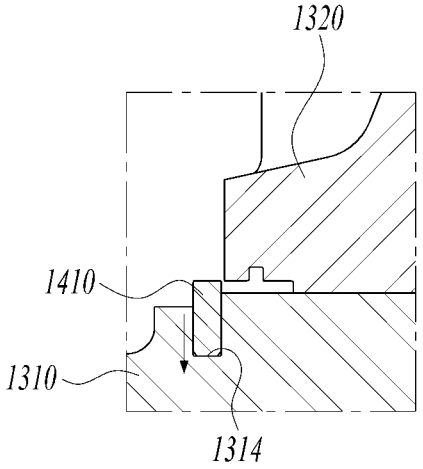
FIG. 10A is a view illustrating a process of inserting the inner fixing member according to an exemplary embodiment.
Figure 10B:
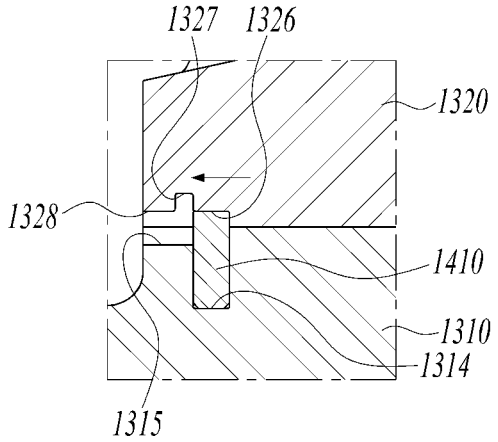
FIG. 10B is a view illustrating a process of coupling the blade to the rotor disk according to an exemplary embodiment.
Figure 10C:
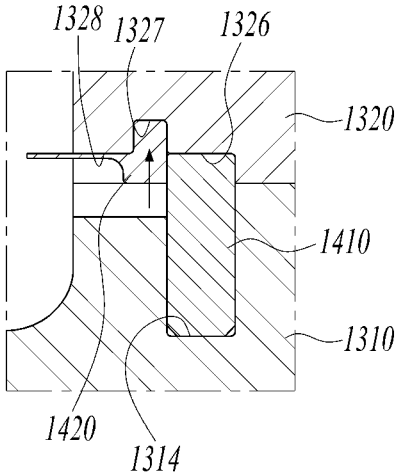
FIG. 10C is a view illustrating a process of mounting the outer fixing member according to an exemplary embodiment.
Figure 10D:
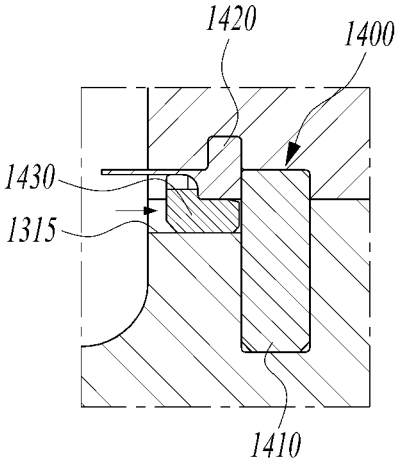
FIG. 10D is a view illustrating a process of mounting the spacer according to an exemplary embodiment.
Figure 10E:
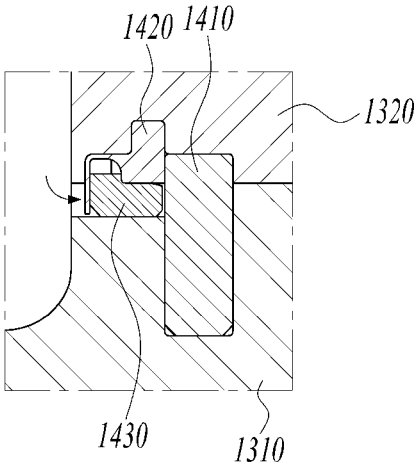
FIG. 10E is a view illustrating a process of fixing the spacer by bending a support plate according to an exemplary embodiment.
Figure 11:
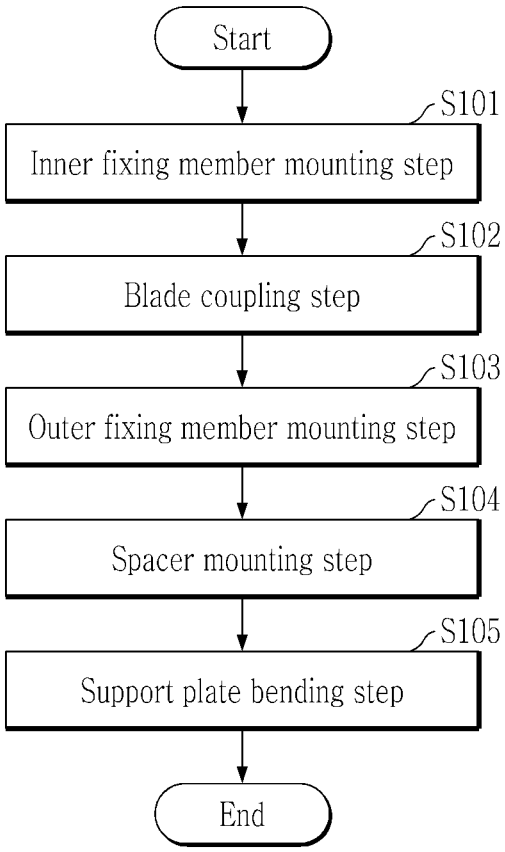
FIG. 11 is a flowchart illustrating a method of assembling a rotary machine according to an exemplary embodiment.

FIG. 10A is a view illustrating a process of inserting the inner fixing member according to an exemplary embodiment, FIG. 10B is a view illustrating a process of coupling the blade to the rotor disk according to an exemplary embodiment, FIG. 10C is a view illustrating a process of mounting the outer fixing member according to an exemplary embodiment, FIG. 10D is a view illustrating a process of mounting the spacer according to an exemplary embodiment, FIG. 10E is a view illustrating a process of fixing the spacer by bending a support plate according to an exemplary embodiment, and FIG. 11 is a flowchart illustrating a method of assembling a rotary machine according to an exemplary embodiment.

Referring to FIGS. 10A to 11, the method of assembling rotary machine includes an inner fixing member mounting step (operation S101), a blade coupling step (operation S102), an outer fixing member mounting step (operation S103), a spacer mounting step (operation S104), and a support plate bending step (operation S105).

In the inner fixing member mounting step (operation S101), the inner fixing member 1410 is inserted into the inner groove 1314 formed in the bottom of the slot 1312 of the rotor disk 1310. Here, the inner fixing member 1410 is formed in a column shape so that a portion of the inner fixing member 1410 is inserted into the inner groove 1314 and an outer side of the inner fixing member 1410 is inserted into the first groove 1326. In the blade coupling step (operation S102), the root part 1325 of the turbine blade 1320 is inserted into the slot 1312 formed in the rotor disk 1310.

In the outer fixing member mounting step (operation S103), the outer fixing member 1320 is inserted into the second groove 1327 formed on the lower surface of the root part 1325 of the turbine blade 1320. Here, the outer fixing member 1420 is moved between the turbine blade 1320 and the rotor disk 1310 through the mounting groove 1315 and the third groove 1328, and then is pushed into the second groove 1327. Here, the side surface of the outer fixing member 1420 abuts against the inner fixing member 1410, and the support plate 1423 remains inserted into the third groove 1328.

In the spacer mounting step (operation S104), the spacer 1430 is inserted into the outer fixing member 1420 through the mounting groove 1315 to prevent the outer fixing member 1420 from being separated from the second groove 1327. Here, the spacer 1430 is disposed between the outer fixing member 1420 and the rotor disk 1310 to prevent the outer fixing member 1420 from being separated into the mounting groove 1315.

In the support plate bending step (operation S105), the support plate 1423 formed on the outer fixing member 1420 is bent so that the support plate 1423 comes into contact with the end of the spacer 1430. Accordingly, the spacer 1430 may be stably positioned without being separated by the support plate 1423.

On the other hand, in order to repair the turbine blade 1320 by separating the turbine blade 1320 from the rotor disk 1310, after straightening the support plate, a tool may be inserted between the protrusions 1432 and hung on the support step portion 1433 to remove the space, and then the outer fixing member 1420 may be removed and the turbine blade 1320 may be removed from the rotor disk 1310.

Hereinafter, a rotary machine according to a second exemplary embodiment will be described.

Figure 12:
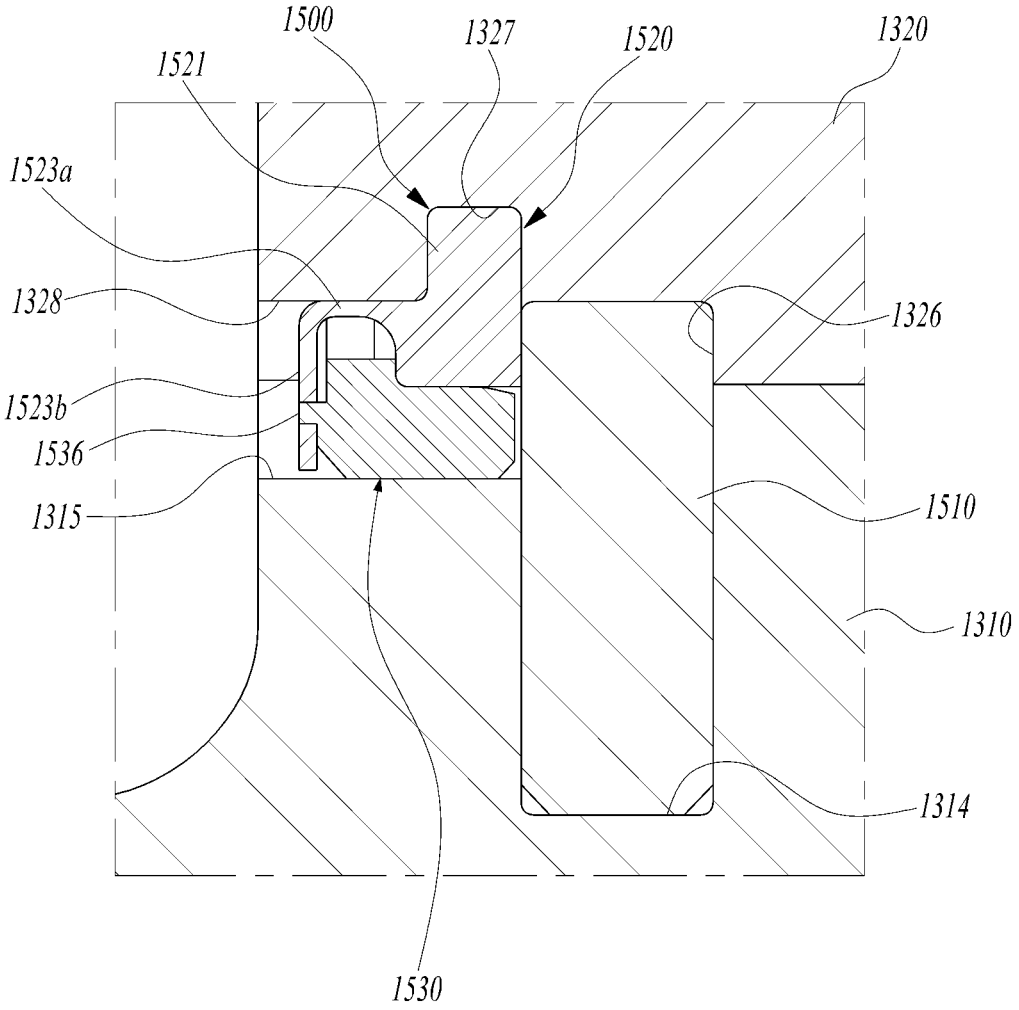
FIG. 12 is a sectional view illustrating a retainer coupled to a rotor disk and a blade according to a second exemplary embodiment.
Figure 13:
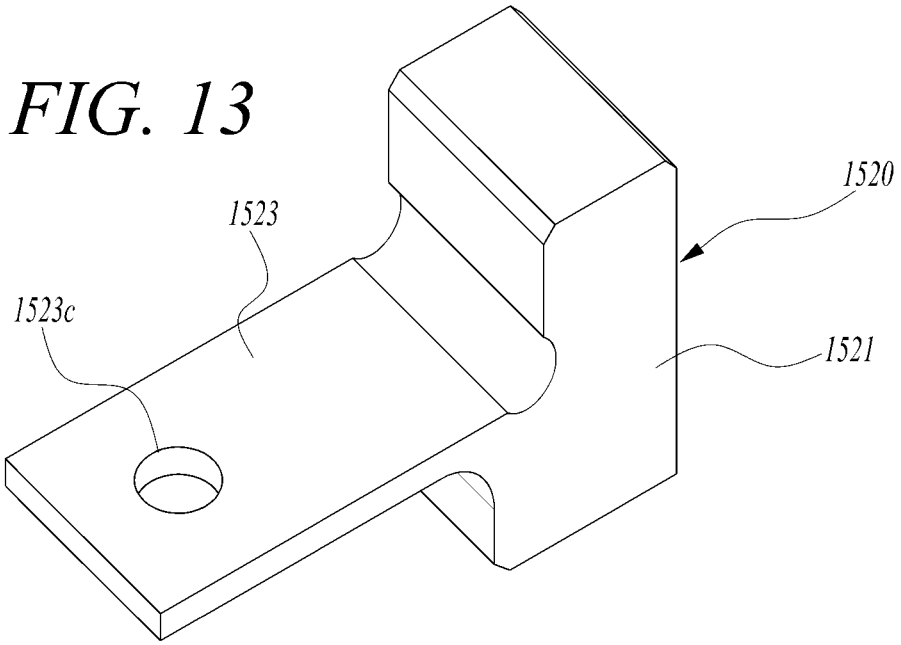
FIG. 13 is a perspective view illustrating an outer fixing member according to the second exemplary embodiment.
Figure 14:
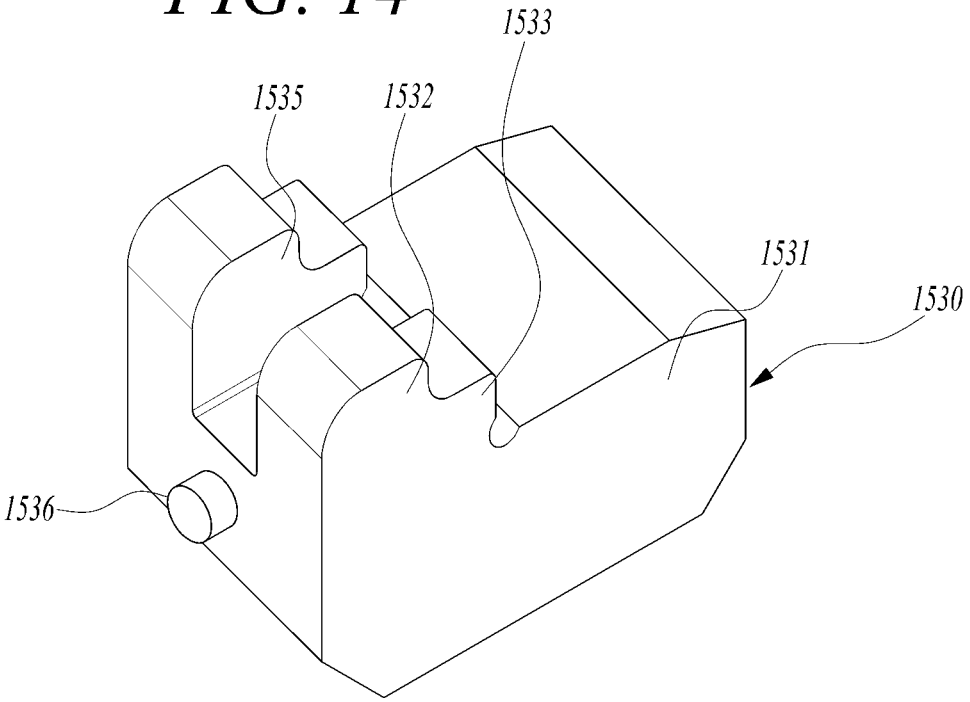
FIG. 14 is a perspective view illustrating a spacer according to the second exemplary embodiment.

FIG. 12 is a sectional view illustrating a retainer coupled to a rotor disk and a blade according to a second exemplary embodiment, FIG. 13 is a perspective view illustrating an outer fixing member according to the second exemplary embodiment, and FIG. 14 is a perspective view illustrating a spacer according to the second exemplary embodiment.

Referring to FIGS. 12 to 14, the rotary machine according to the second exemplary embodiment has the same structure as the rotary machine according to first exemplary embodiment except for a retainer 1500, so a redundant description thereof will be omitted.

The retainer 1500 may include an inner fixing member 1510 inserted into the bottom of the slot 1312, an outer fixing member 1520 inserted into the lower side of the root part 1325 to abut against the inner fixing member 1510, and a spacer 1530 inserted between the outer fixing member 1520 and the bottom of the slot 1312 to prevent the outer fixing member 1520 from being separated.

The inner fixing member 1510 may have a cylindrical shape and may be inserted into the inner groove 1314 and the first groove 1326. The outer fixing member 1520 is inserted into the second groove 1327 to contact and support the inner fixing member 1510. The outer fixing member 1520 has a body portion 1521 inserted into the second groove 1327 and a support plate 1523 protruding in the axial direction from the body portion 1521. The support plate 1523 protrudes from a side surface of the body portion 1521 and is bent to contact the end of the spacer 1530.

The spacer 1530 may have a support block 1531 supporting the outer fixing member 1520 and protrusions 1532 protruding from the support block 1531 toward the turbine blade 1320. The support block 1531 may be inserted into the mounting groove 1315, and the protrusion 1532 may be inserted into the third groove 1328.

The support block 1531 contacts an inner end of the outer fixing member 1520 to prevent the outer fixing member 1520 from being separated from the second groove 1327. The two protrusions 1532 are spaced apart from each other, and a middle groove 1535 extending downward is formed between the protrusions 1532. In addition, a protruding support step portion 1533 is formed on the support block 1531.

Further, a coupling protrusion 1536 protruding outward is formed on an outer surface of the support block 1531. The coupling protrusion 1536 may have a circular or polygonal cross-section.

The support plate 1523 is bent in a state in which the spacer 1530 is mounted so that the support plate 1523 abuts against the outer end of the spacer 1530, thereby preventing the spacer 1530 from being separated between the turbine blade 1320 and the rotor disk 1310 by the support plate 1523.

The support plate 1523 may have a first portion 1523*a* protruding from the body portion 1521 in a lateral direction to abut against the bottom of the third groove 1328 and a second portion 1523*b* bent at the first portion 1523*a* to abut against the spacer 1530. The first portion 1523*a* may contact the protrusion 1532, and the second portion 1523*b* may contact the protrusion 1532 and the support block 1531.

The support plate 1523 may include a coupling hole 1523*c* fitted with the coupling protrusion 1536. For example, the coupling hole 1523*c* may be formed in the second portion 1523*b* of the support plate 1523. When the coupling protrusion 1536 and the coupling hole 1523*c* are engaged, the support plate 1523 may support the spacer 1530 more stably.

Hereinafter, a rotary machine according to a third exemplary embodiment will be described.

Figure 15:
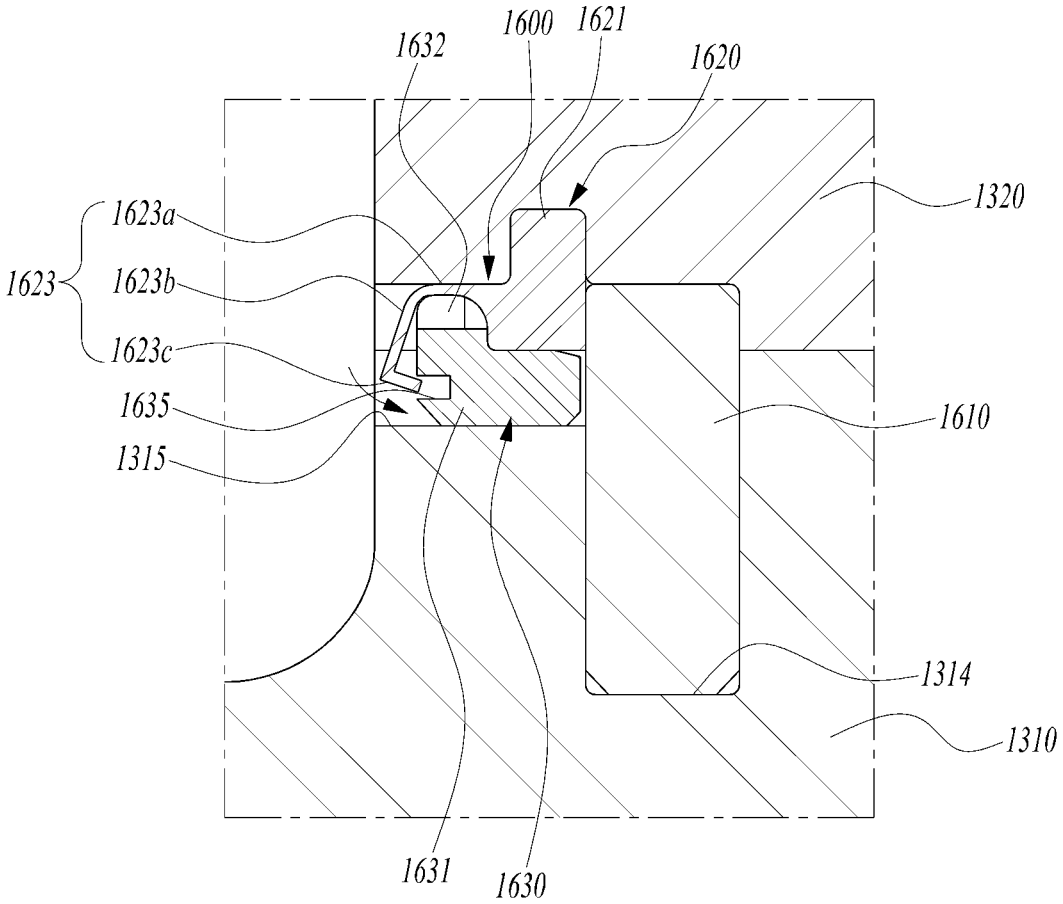
FIG. 15 is a sectional view illustrating a retainer coupled to a rotor disk and a blade according to a third exemplary embodiment.

FIG. 15 is a sectional view illustrating a retainer coupled to a rotor disk and a blade according to a third exemplary embodiment.

Referring to FIG. 15, the rotary machine according to the third exemplary embodiment has the same structure as the rotary machine according to the first exemplary embodiment except for a retainer 1600, so a redundant description thereof will be omitted.

The retainer 1600 may include an inner fixing member 1610 inserted into the bottom of the slot 1312, an outer fixing member 1620 inserted into the lower side of the root part 1325 to abut against the inner fixing member 1610, and a spacer 1630 inserted between the outer fixing member 1620 and the bottom of the slot 1312 to prevent the outer fixing member 1620 from being separated.

The inner fixing member 1610 may have a cylindrical shape. The outer fixing member 1620 is inserted into the lower side of the root part 1325 of the turbine blade 1320 and is supported in contact with the inner fixing member 1610. The outer fixing member 1620 has a body portion 1621 inserted into the root part 1325 and a support plate 1623 protruding in the axial direction from the body portion 1621. The support plate 1623 protrudes from the side surface of the body portion 1621 in the lateral direction and is bent to contact the end of the spacer 1630.

The spacer 1630 may have a support block 1631 supporting the outer fixing member 1620 and a protrusion 1632 protruding from the support block 1631 toward the turbine blade 1320. An accommodation groove 1635 into which the support plate 1623 is inserted may be formed at an end side of the support block 1631.

The support plate 1623 is bent in a state in which the spacer 1630 is mounted inside the outer fixing member 1620 so that the spacer 1630 abuts against the outer end of the spacer 1630, thereby preventing the spacer 1630 from being separated between the turbine blade 1320 and the rotor disk 1310.

The support plate 1623 may have a first portion 1623*a* protruding from the body portion 1621 in the lateral direction, a second portion 1623*b* bent from the first portion 1623*a* to abut against the spacer 1630, and a third portion

1623*c* bent from the second portion 1623*b* and inserted into the accommodation groove 1635. The first portion 1623*a* may contact the protrusion 1632, and the second portion 1623*b* may contact the protrusion 1632 and the support block 1631. The third portion 1623*c* is inserted into the accommodation groove 1635 formed on the outer surface of the support block 1631 to support the spacer 1630.

While exemplary embodiments have been described with reference to the accompanying drawings, it will be apparent to those skilled in the art that various modifications in form and details can be made therein without departing from the spirit and scope as set forth in the appended claims. Therefore, the description of the exemplary embodiments should be construed in a descriptive sense and not to limit the scope of the claims, and many alternatives, modifications, and variations will be apparent to those skilled in the art.

What is claimed is:

1. A rotary machine comprising:

a rotor disk including a plurality of slots;

a plurality of blades mounted on an outer circumferential surface of the rotor disk, each of the blades having a root part inserted into an associated one of the slots; and a retainer restraining axial movement of the plurality of blades, wherein the retainer comprises an inner fixing member inserted into a bottom of the slot, an outer fixing member inserted into a lower surface of the root part to abut against the inner fixing member, and a spacer inserted between the outer fixing member and the bottom of the slot to prevent the outer fixing member from being separated, wherein the bottom of the slot is provided with an inner groove into which the inner fixing member is inserted.

2. The rotary machine according to claim 1, wherein the outer fixing member includes a body portion inserted into the root part and a support plate protruding from the body portion in a lateral direction and bent to abut against an end of the spacer.

3. The rotary machine according to claim 2, wherein the bottom of the slot is provided with a mounting groove connected to an upper portion of the inner groove and extending from the inner groove to a side surface of the rotor disk.

4. The rotary machine according to claim 3, wherein the lower surface of the root part is provided with a first groove into which the inner fixing member is inserted, a second groove into which the outer fixing member is inserted and formed deeper than the first groove, and a third groove extending from the second groove to the side surface of the root part.

5. The rotary machine according to claim 4, wherein the inner fixing member has a column shape and is inserted into the inner groove and the first groove.

6. The rotary machine according to claim 4, wherein the spacer includes a support block supporting the outer fixing member and protrusions protruding from the support block toward the blade to be inserted into the third groove.

7. The rotary machine according to claim 6, wherein two protrusions are spaced apart from each other, and a middle groove is formed between the two protrusions, and a protruding support step portion is formed on the support block.

8. The rotary machine according to claim 4, wherein the support plate includes a first portion protruding from the body portion in the lateral direction to abut against the bottom of the third groove and a second portion bent from the first portion to abut against the spacer.

9. The rotary machine according to claim 8, wherein the spacer includes an accommodation groove, and the support plate further includes a third portion bent from the second portion and inserted into the accommodation groove.

10. The rotary machine according to claim 2, wherein the spacer includes a coupling protrusion, and the support plate includes a coupling hole into which the coupling protrusion is fitted.

11. A gas turbine comprising:

a compressor configured to compress air introduced from an outside;

a combustor configured to mix the compressed air compressed by the compressor with fuel and combust an air-fuel mixture to produce combustion gas; and a rotary machine rotated by the combustion gas produced by the combustor, wherein the rotary machine comprises:

a rotor disk including a plurality of slots;

a plurality of blades mounted on an outer circumferential surface of the rotor disk, each of the blades having a root part inserted into an associated one of the slots; and a retainer restraining axial movement of the plurality of blades, wherein the retainer comprises an inner fixing member inserted into a bottom of the slot, an outer fixing member inserted into a lower surface of the root part to abut against the inner fixing member, and a spacer inserted between the outer fixing member and the bottom of the slot to prevent the outer fixing member from being separated, wherein the bottom of the slot is provided with an inner groove into which the inner fixing member is inserted.

12. The gas turbine according to claim 11, wherein the outer fixing member includes a body portion inserted into the root part and a support plate protruding from the body portion in a lateral direction and bent to abut against an end of the spacer.

13. The gas turbine according to claim 12, wherein the bottom of the slot is provided with a mounting groove connected to an upper portion of the inner groove and extending from the inner groove to a side surface of the rotor disk.

14. The gas turbine according to claim 13, wherein the lower surface of the root part is provided with a first groove into which the inner fixing member is inserted, a second groove into which the outer fixing member is inserted and formed deeper than the first groove, and a third groove extending from the second groove to the side surface of the root part.

15. The gas turbine according to claim 14, wherein the spacer includes a support block supporting the outer fixing member and protrusions protruding from the support block toward the blade to be inserted into the third groove.

16. The gas turbine according to claim 15, wherein two protrusions are spaced apart from each other, and a middle groove is formed between the two protrusions, and a protruding support step portion is formed on the support block.

17. The gas turbine according to claim 14, wherein the support plate includes a first portion protruding from the body portion in the lateral direction to abut against the bottom of the third groove and a second portion bent from the first portion to abut against the spacer.

18. The gas turbine according to claim 17, wherein the spacer includes an accommodation groove, and the support plate further includes a third portion bent from the second portion and inserted into the accommodation groove.

19. The gas turbine according to claim 12, wherein the spacer includes a coupling protrusion, and the support plate includes a coupling hole into which the coupling protrusion is fitted.

20. A method of assembling a rotary machine including a rotor disk and a plurality of blades, the method comprising:

mounting an inner fixing member by inserting a column-shaped inner fixing member into an inner groove formed in a bottom of a slot of the rotor disk;

coupling a blade to the slot of the rotor disk;

mounting an outer fixing member by inserting the outer fixing member which supports the blade into a second groove formed in a lower surface of a root part of the blade;

mounting a spacer by inserting a spacer which supports the outer fixing member into an inner side of the outer fixing member; and bending a support plate formed on the outer fixing member to abut against an end of the spacer.

* * * * *